US009045200B1

(12) United States Patent
Chaney

(10) Patent No.: US 9,045,200 B1
(45) Date of Patent: Jun. 2, 2015

(54) FLOATING CRAFT STABILIZING PLATFORM

(71) Applicant: John Chaney, Portland, OR (US)

(72) Inventor: John Chaney, Portland, OR (US)

( * ) Notice: Subject to any disclaimer, the term of this patent is extended or adjusted under 35 U.S.C. 154(b) by 31 days.

(21) Appl. No.: 14/102,154

(22) Filed: Dec. 10, 2013

(51) Int. Cl.
*B63B 35/14* (2006.01)
*B63B 17/00* (2006.01)
*B63B 7/02* (2006.01)

(52) U.S. Cl.
CPC ..... *B63B 35/14* (2013.01); *B63B 17/00* (2013.01); *B63B 7/02* (2013.01)

(58) Field of Classification Search
CPC ..... A47C 15/006; B63B 35/74; B63B 35/78
See application file for complete search history.

(56) References Cited

U.S. PATENT DOCUMENTS 1,555,589 A * 9/1925 La Farina ..... 441/132
2,010,371 A * 8/1935 Perri ..... 441/35
2,332,009 A * 10/1943 Perri ..... 441/130

* cited by examiner

*Primary Examiner* — Edwin Swinehart
(74) *Attorney, Agent, or Firm* — Mark S Hubert

(57) ABSTRACT

An accessory for addition onto a floating pontoon style fishing craft that enables the occupant to safely stand while the craft is floating without fear of tipping the craft. This is in the form of a lowerable, retractable platform that resides below the waterline of the craft and also incorporates a removeable working table/safety bar that resides in front of the occupant's seat to constrain them from falling overboard and to allow them a stable work surface from which to perform fishing related activities. The retractable platform serves to allow the center of gravity of the occupant to remain in close proximity to the waterline of the craft thus preventing tipping. Because of the depth the platform projects beneath the craft, the position of the occupant's mass acts as a stabilizer or ballast rudder so as to let the occupant to safely cast his fishing line from the craft.

12 Claims, 8 Drawing Sheets

FLOATING CRAFT STABILIZING PLATFORM

BACKGROUND OF THE INVENTION

The present invention relates to an extremely compact accessory for connection to a floating craft, targeted at personal floating pontoon fishing vessels, and adapted to provide both safety and convenience for the user. More particularly, to a system comprised of a retractable, lowerable platform and a table/safety bar restraint that can be retrofit onto a plethora of existing floating craft.

Personal, floating pontoon fishing vessels are quite popular with fishmen. One of the major drawbacks with these vessel is that the act of casting is limited for three reasons. First, when seated in the craft casting is accomplished forward of the occupant and the craft. There is no method for the occupant to pivot around in his seat to cast behind him. This is necessary as the craft rotates with the current as it moves down the river. Second, casting must be done from a seated position rather than the natural standing position. Lastly, the action of casting rocks the vessel making it somewhat unstable and dangerous.

Another drawback of these craft is that there is limited space and places from which to tie a fly, change a lure or work on a landed fish. While these type of craft are of great advantage for fisherman and offer improved features over shoreline or bank fishing, they are not able to reach their full potential for avid fishermen.

Henceforth, a retrofitable system for a pontoon float craft that would allow the occupant to cast in all directions safely coupled with a working platform would fulfill a long felt need in the fishing industry. This new invention utilizes and combines known and new technologies in a unique and novel configuration to overcome the aforementioned problems and accomplish this.

SUMMARY OF THE INVENTION

The general purpose of the present invention, which will be described subsequently in greater detail, is to provide a lowerable, retractable platform that resides below the waterline of the craft and also incorporates a removeable working table/safety bar that resides in front of the occupant's seat to constrain them from falling overboard and to allow them a stable work surface from which to perform fishing related activities. The retractable platform (when stood upon) serves to allow the center of gravity of the occupant to remain in close proximity to the waterline of the craft thus preventing tipping. Because of the depth the platform projects beneath the craft, the position of the occupant's mass acts as a stabilizer or ballast rudder so as to let the occupant to safely cast his fishing line from the craft.

It has many of the advantages mentioned heretofore and many novel features that result in a new pontoon craft retrofittable system which is not anticipated, rendered obvious, suggested, or even implied by any of the prior art, either alone or in any combination thereof.

In accordance with the invention, an object of the present invention is to provide an improved lowerable, retractable fishing platform for a pontoon craft that (in combination with the occupant's weight) is capable of supporting the weight of a fisherman, and that acts as a below waterline ballast to stabilize the craft.

It is another object of this invention to provide an improved work surface capable that is capable of being retrofitted onto a plethora of existing pontoon craft via an adjustable attachment system.

It is a further object of this invention to provide a safety restraint device that can be affixed adjustably to a plethora of pontoon craft to ensure the occupant's safety when in the water.

The subject matter of the present invention is particularly pointed out and distinctly claimed in the concluding portion of this specification. However, both the organization and method of operation, together with further advantages and objects thereof, may best be understood by reference to the following description taken in connection with accompanying drawings wherein like reference characters refer to like elements. Other objects, features and aspects of the present invention are discussed in greater detail below.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting. There are, of course, additional features of the invention that will be described hereinafter and which will form the subject matter of the claims appended hereto. As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

BRIEF DESCRIPTION OF THE DRAWINGS

FIG. 3 is a front side perspective view of the extended stabilizing platform lowered showing the general arrangement of all components;

FIG. 4 is a front side perspective view of the extended stabilizing platform lowered with the operating handles extended, showing the general arrangement of all components;

FIG. 5 is a front side perspective view of the retracted stabilizing platform and the operating handle extended, showing the general arrangement of all components;

FIG. 6 is a front side perspective view of the retracted stabilizing platform with the operating handle retracted, showing the general arrangement of all components;

DETAILED DESCRIPTION

Figure 1:
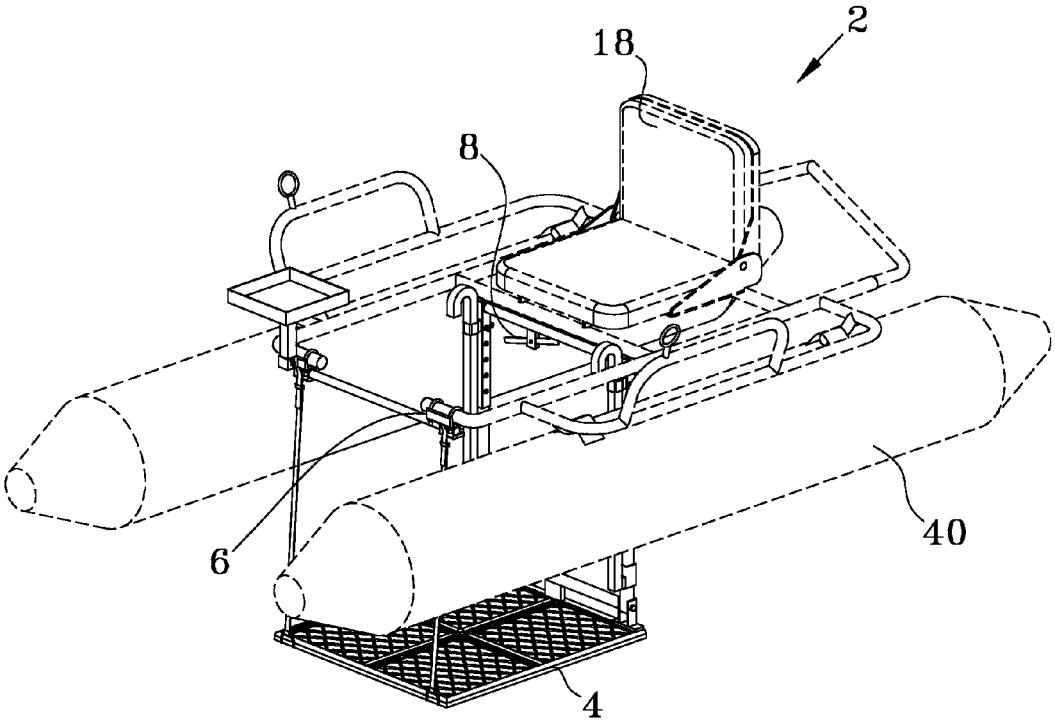
FIG. 1 is a front side perspective view of the extended stabilizing platform showing the general arrangement of all components installed on a floating craft.
Figure 2:
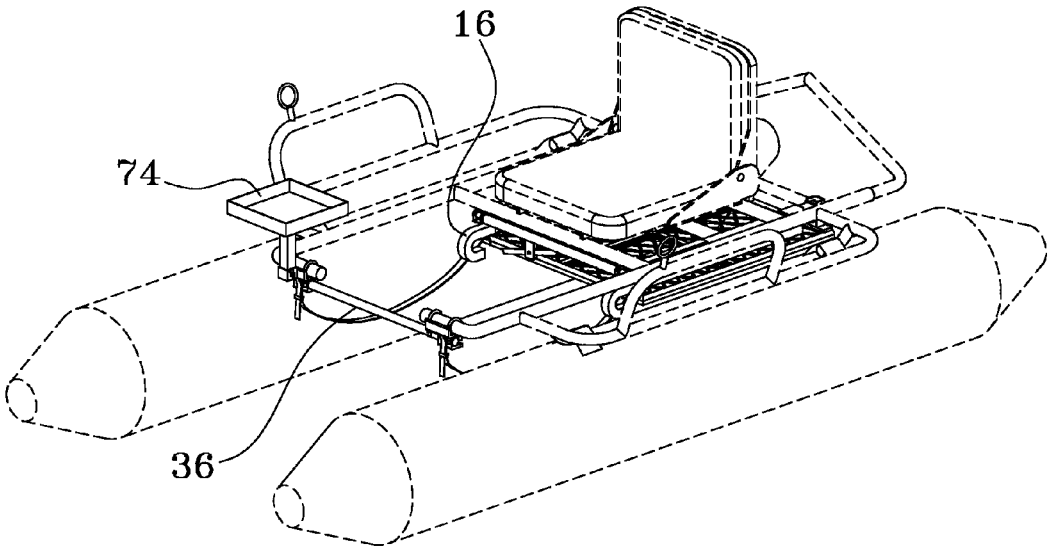
FIG. 2 is a front side perspective view of the retracted stabilizing platform showing the general arrangement of all components installed on a floating craft.

The above description will enable any person skilled in the art to make and use this invention. It also sets forth the best modes for carrying out this invention. There are numerous variations and modifications thereof that will also remain readily apparent to others skilled in the art, now that the general principles of the present invention have been disclosed. There has thus been outlined, rather broadly, the more important features of the invention in order that the detailed description thereof that follows may be better understood and in order that the present contribution to the art may be better appreciated.

As can best be seen in FIGS. 1, 2, 8 and 17 the floating craft stabilization platform 2 consists of a perforated, pivotable platform 4, an optional universal fit front mounting assembly 6, a platform lock assembly 8, a pair of adjustable fabric straps 10, an upper axle tube 12, a lower axle tube 13, an upper axle 15 a lower axle 17, a pair of adjustable, pivotable legs 14, a pair of lifting handles 16, a safety bar 36 and a table 74.

The stabilizing platform 2 is a retrofit accessory designed to attach to the various configurations of floating craft frames presently on the market. There are various floating craft manufacturers and there is a plethora of different frame designs that affix to and support the seat 18 and pontoons 40. The frame tubing used may be round, square or elliptical in cross section. The present design utilizes a pair of universal fit front mounting bracket assemblies 6 and an upper axle tube 12 that will accommodate the connection of the platform to the various configurations and dimensions of frame tubes. Since the platform is designed for use in salt, brackish or freshwater environments the components are rust and salt resistant by material and/or coating selection. In the preferred embodiment these are made of lightweight metal such as aluminum, although a UV resistant polymer would also be suitable as would be powder coated or stainless steel or galvanized metal.

The front mounting bracket assembly 6 (FIGS. 9-12) is made of an upper U shaped piece of channel 42 joined to a lower U shaped piece of channel 44. One side of the lower channel 44 is affixed to the bottom of the upper channel 42 such that their linear axes are parallel, but the open face of their U shapes are perpendicular. A strap connector 46 extends from the bottom of the upper channel 42. A set of U-bolts 48 are threadingly engaged with mating nuts 50 through orifices in the upper channel 42 so as to form two enclosed rings that allow the connection of the front mounting bracket assembly 6 to the floating craft frame members. It is to be noted that the strap connector 46 may be utilized as a connection point for the straps 10 or not, as the straps may directly encircle the frame or may be situated so as to directly encircle the front mounting bracket assembly 6 when mounted on the frame.

It is known that in an alternate embodiment the front mounting bracket assembly 6 may be eliminated completely. This would be done when the user has no need for a safety bracket 36. In this configuration the straps 10 have their top end looped around the frame of the floating craft rather than around the front mounting bracket assembly 6 or around the strap connector 46 on the front mounting bracket assembly 6. In all other aspects the straps 10 would function identically.

The straps 10 are of a flexible fabric adapted for use in water that have their proximate ends looped through the strap connector 46 (or encircling the frame) and then enmeshed with an adjustment buckle 20 located on the straps between the distil and proximate ends. The perforated platform 4 is a generally rectangular, planar member with numerous perforations 5 formed there through to allow water to freely pass. (FIGS. 13-16) Affixed to the front edge of the platform 4 is a pair of platform strap loops 7 through which the distil end of the strap 10 is attached. In another embodiment of connection, the two ends of the adjustable strap may just be joined at the buckle 20. In either configuration, the front of the platform 4 may be raised or lowered by adjusting the amount of strap 10 that passes through the buckle 20.

Figure 7:
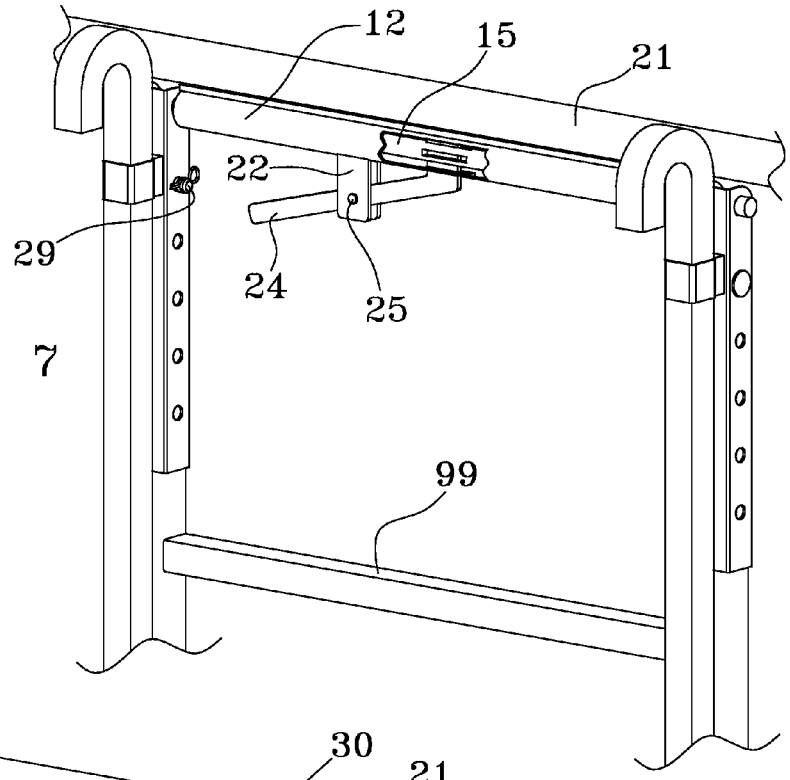
FIG. 7—is a front perspective view of the platform locked in the fully extended position.
Figure 8:
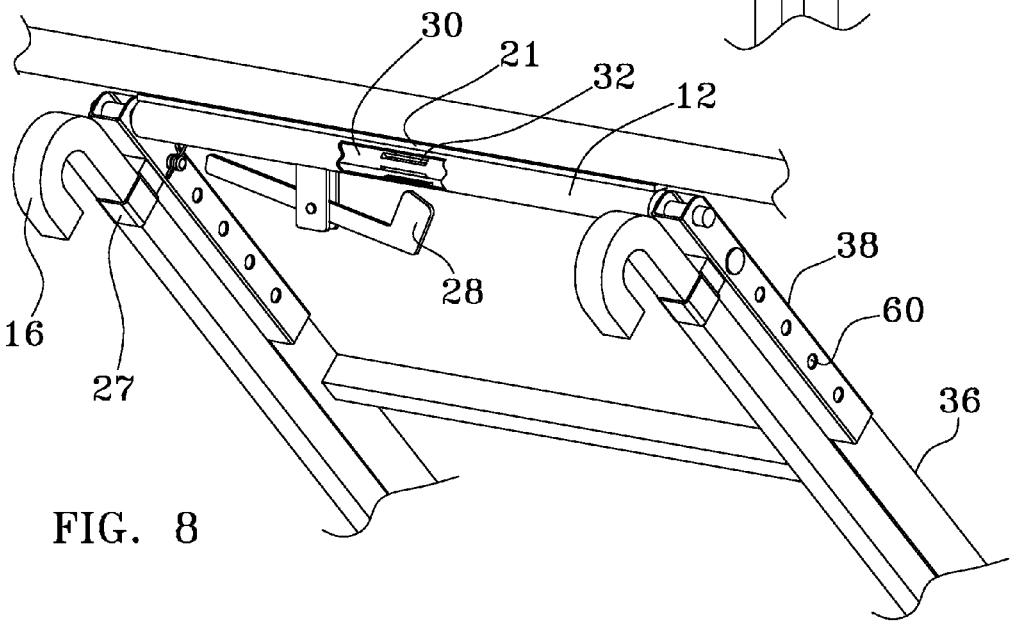
FIG. 8—is a front perspective view of the platform unlocked from the fully extended position and with the platform partially raised.
Figure 9:
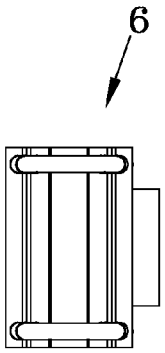
FIGS. 9-12 are top, front, perspective and side views of the front mounting bracket assembly.
Figure 11:
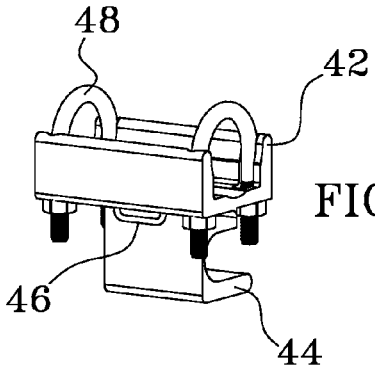
Figure 10:
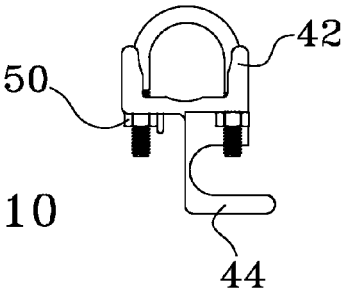
Figure 12:
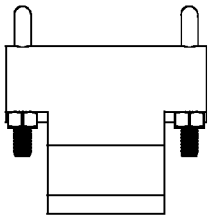
Figure 13:
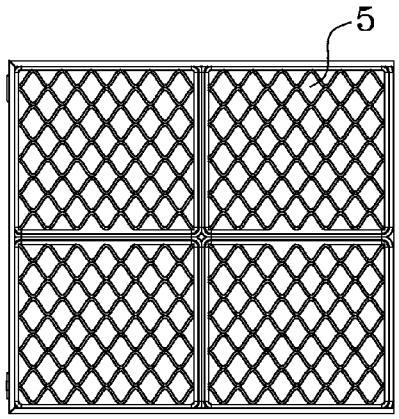
FIGS. 13-16 are a top, side, perspective and front views of the platform.
Figure 15:
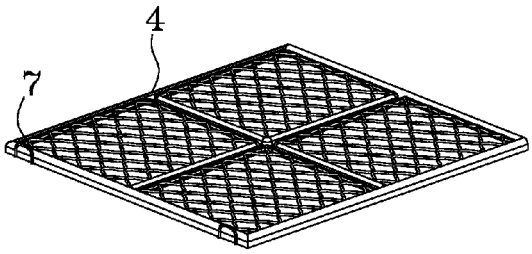
Figure 14:
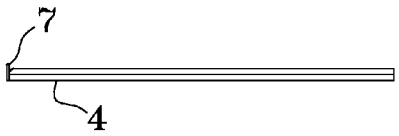
Figure 16:
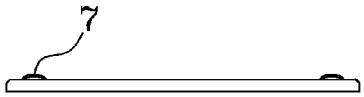
Figure 17:
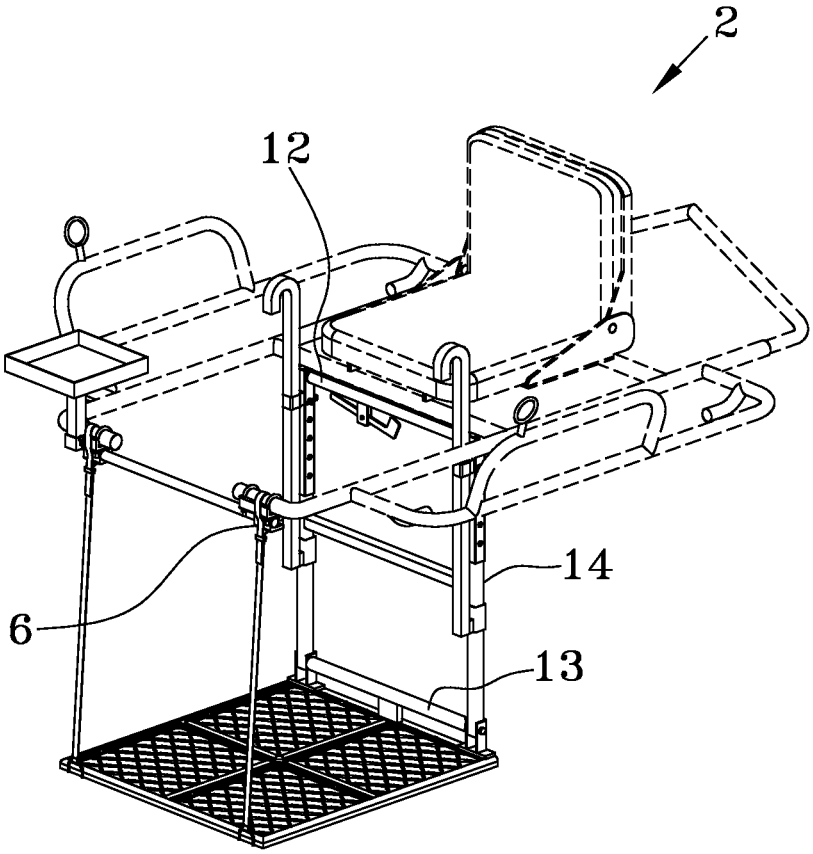
FIG. 17 is a side perspective of the floating craft with the pontoons removed and the platform ready for raising.

Looking at FIGS. 7 and 8 it can be seen that under the seat, affixed to the pontoon boat's frame crossmember (shown in phantom) is the upper axle tube 12. This tube may be welded or mechanically affixed to the crossmember by bolts or clamps. In the preferred embodiment there is a section of flat bar 21 affixed to the upper axle tube 12 and that serves as the point of connection between the upper axle tube 12 and the crossmember by welding. On the upper axle tube 12 extends a locking lever assembly made of a locking lever arm 24 that pivots about pivot pin 25 which is affixed to locking lever bracket 22. The locking lever arm has a leg portion 28 that will extend through a slot cut in the upper axle tube 12 so as to reside within one of the alignable locking slots 32 cut in the upper axle 30. When the handle portion of the locking lever arm 24 is raised the leg portion 28 will disengage from the upper axle 30 allowing the upper axle 30 to freely pivot within the upper axle tube 12 and raise or lower the two legs 14.

The platform 4 is of a generally planar configuration with a series of perforations 5 formed therethrough. At the front of the platform 4 is a pair of strap loops 7 that extend to allow passage of the strap 10 which suspends the front end of the platform 4. The rear of the platform is pivotally attached to the legs 14 by the lower axle tube 13, the lower axle 17 as described herein.

The leg 14 is comprised of an inner leg member 36 which slidingly resides within outer leg member 38 so as to enable a telescopic style adjustment of leg 14. There are a set of matchingly dimensioned locking pin orifices 60 formed through both the outer leg member 38 and the inner leg member 36 so as to accommodate locking pin 23 to affix the length of the leg 14. Attached to the outer leg member 38 is a top guide 27 which keeps the handle 16 and the leg 14 parallel and adjacent at all times. An optional stabilizing brace 99 is affixed between inner leg members 36. At the bottom of the inner leg members 36 are orifices that accept either end of a lower axle 17 for pivotal motion. The lower end of the inner leg members 36 resides within lower leg brackets comprised of an outer plate 62 and an inner plate 64 which reside parallel to each other and extend normally from the rear edge of platform 4. The lower axle tube 13 is affixed at either end to one of the inner plates 64 and rotationally houses lower axle 17 which passes through an orifice in the inner plate (not visible) and an orifice in the outer plate 62. There is also an optional support 98 that may be used to affix the midpoint of the lower axle tube 13 to the platform's rear edge. The lower axle may be retained therein by a number of mechanical means including mushrooming the axle ends, pins, bolting arrangements, devises, and the like. This design enables pivoting movement of the platform 4 with respect to the legs 14 as the platform 4 is raised or lowered. There is a series of matingly sized orifices formed through the inner leg member 36 and the outer leg member 38 that align at different extensions so as to receive an adjustment pin 29 to lock the leg 14 at the desired length.

The handle 16 is a linear member having a bottom guide 54 affixed thereto that is slidingly attached to the leg 14 by inserting the handle 16 first through the top guide 26 then sliding the inner leg member 36 (deattached) through the bottom guide 54 of the handle, then assembling the outer and inner leg members. There are many embodiments of a handle possible as the handle 16 is but a lifting mechanism. It need not be rigidly or slidingly affixed to the leg 14, rather it could be a cable or stay arrangement that serves simply as a mechanism to lift the leg 14.

Figure 3:
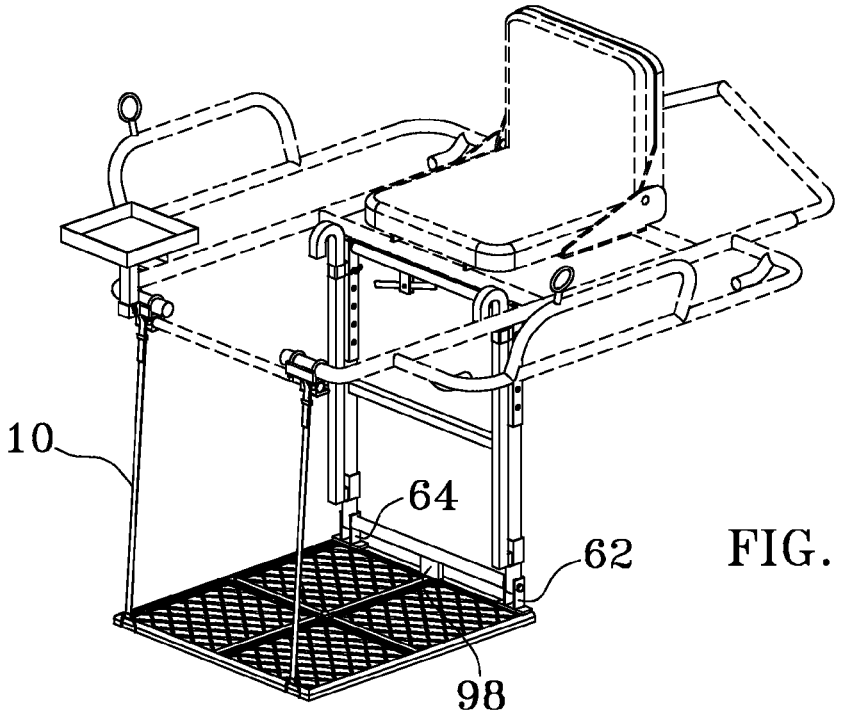
FIGS. 3-6 are a series of time staggered illustrations showing the steps required to raise and lock the platform.
Figure 4:
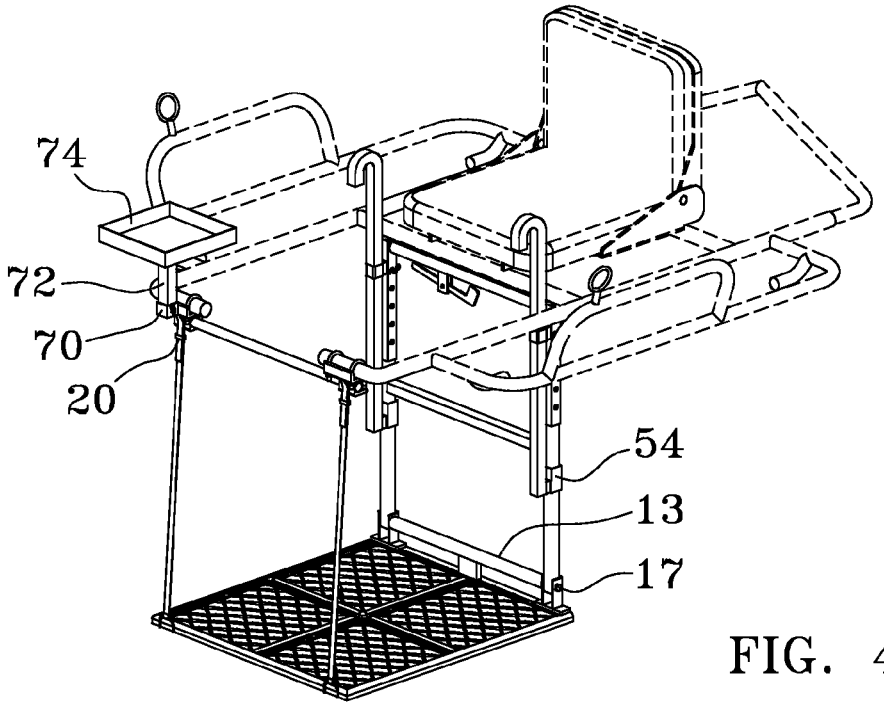
Figure 5:
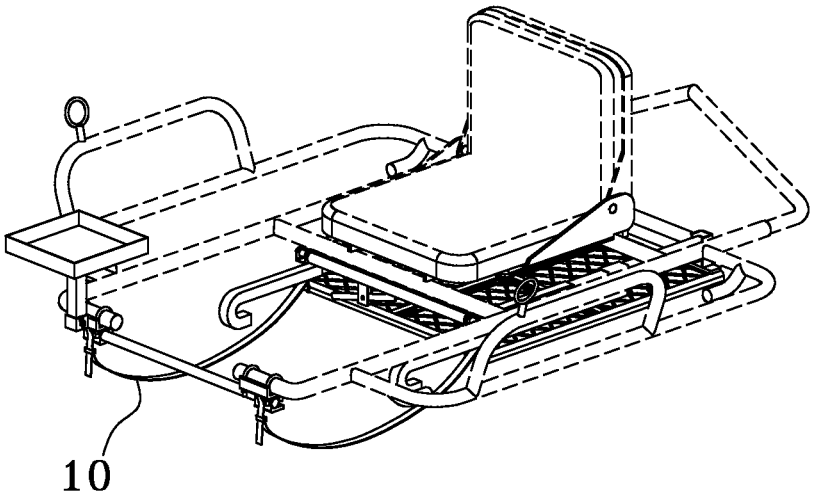
Figure 6:
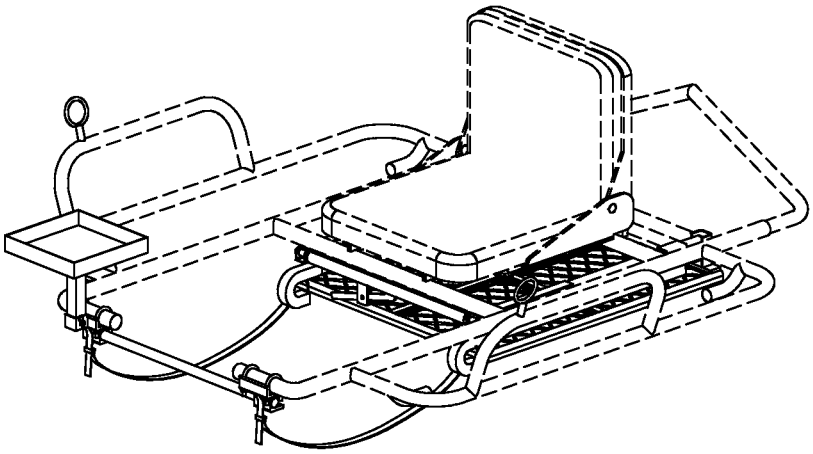

Attachment of the stabilizing platform 2 requires the user to affix the front mounting bracket assemblies 6 to the tubular frame of the craft with the U bolts and mechanically affixing the upper axle tube 12 to the crossmember. Looking at FIGS. 3-6 in conjunction with FIGS. 7 and 8, the operation of the platform 2 can best be illustrated. The platform 4 resides in the water below and in front of the floating craft's seat 18. The actual depth of the platform 4 is determined by adjustments of the buckles 20 on the straps 10 and the telescopic extension or retraction of the inner leg member 36 from within outer leg member 38. There is a series of matingly sized orifices formed through the inner leg member 36 and the outer leg member 38 that align at different extensions so as to receive an adjustment pin 29 to lock the leg 14 at the desired length. When adjusted properly, this results in a generally horizontal platform orientation. (FIG. 3) The handles 16 are raised vertically and are constrained adjacent and parallel to the legs 14 by handle mounted bottom guides 54 and outer leg member mounted top guide 27. (FIG. 4) The handle portion of the locking lever arm 24 is raised so that the leg portion 28 will disengage from the upper axle 30 and allow upper axle 30 to freely pivot within the upper axle tube 12 and raise or lower the two legs 14 when the handles 16 are pushed forward and down (toward the waterline at the bow of the craft). This action will cause the legs 14 and platform 4 to pivot up and back (FIG. 8) toward the stern of the craft. Because the platform 4 is pivotally affixed to the legs 14 by a lower axle assembly, as the legs 14 are pivoted rearward the platform remains in a horizontal position by the tension between the straps 10 and the strap loops 96 on the front of the platform 4. When the platform 4 reaches the fully raised position such that it tucks in underneath the seat 18 the handle portion of the locking lever arm 24 is lowered so that the leg portion 28 will engage the slots in the upper axle 30 to lock the upper axle 30 within the upper axle tube 12 and hold the legs 14 and platform 4 in the retracted position. (FIG. 5) The handles 16 are then slid backward and out of the way. With the use of the straps 10 to secure the front of the platform 4 there are no hard obstacles for the user to bump his legs on when the platform 4 is in the retracted position.

Depth adjustment of the platform 4 is set to accommodate the leg length of the user such that they can easily return to a seated position and that the safety bar 36 (FIG. 17) is between the knee and waist of the user.

When the platform 4 is lowered the user may stand on it to cast his line in any direction. This stabilizes the craft as the user and platform assembly combined, now function as a ballast to keep the craft from tipping as the user turns to cast in different directions. It also allows functions as a rudder to keep the craft moving in line with the current in a river, creek or stream rather than moving directionally with the surface wind. In the case of lake usage, it prevents the craft from blowing about.

The platform 4 and legs 12 whether retracted or extended serve as a ballast to help stabilize the floating craft. Although not having a substantial mass, the perforated design of the platform 4 allows it to offer extreme resistance to movement of the attached craft by virtue of the resistance it offers to water flowing through the perforations as the craft attempts to pivot or move. This feature greatly enhances the stability and safety of the craft.

Between the front mounting bracket assemblies 6 may be a safety bar 36 which is pivotally and removeably affixed to the front bracket assembly 6. This pivot connection and the lock on the other end of the safety bar 36 are well known in the art and are not illustrated. This safety bar serves to stabilize the frame and to prevent the user from falling forward out of the craft while standing on the platform 4. On distal end of the safety bar 36 is a table pedestal support 70 that slidingly engages the pedestal 72 of the table 74. This support is section of tubing with its inside dimensions larger than the outside dimensions of the similarly configured tubing of the table pedestal 72. A wingbolt (not visible) engages a threaded recess in the table pedestal support 70 so as to frictionally engage the pedestal 72 within the table pedestal support 70 and set the height of the table 74.

Although depicted with two handles 16 as the raising/lowering mechanism in an alternate embodiment only one handle would be utilized. In this configuration the other remaining components would remain identical, thereby allowing the user to select on which side he would prefer the handle 16 to be placed. There are other affixing arrangements such as bolting or compression clamping that would be suitable to attach the front mounting assembly 6 to the frame of the craft, (as would be well known in the art) however the one chosen for this device accomplishes the best overall adaptation for connection to the various frame design. Similarly, physical changes to the U shaped configuration of the mounting assemblies are well within the scope of the disclosure above.

I claim:

1. A floating craft stabilization platform for attaching to a frame of a floating craft comprising;

a pivotable platform;

at least one front mounting bracket assembly;

an upper axle assembly made of an upper axle rotationally housed within an upper axle tube;

a lower axle assembly made of a lower axle rotationally housed within a lower axle tube;

at least one adjustable strap;

at least one pivotable, extendable leg having a distal and proximate end; and at least one handle;

wherein said at least one front mounting bracket assembly and said upper axle assembly are mechanically affixed to said frame of a floating craft, and said at least one adjustable strap is adjustably connected between said frame of said floating craft and said platform, and said at least one pivotable, extendable leg proximate end is pivotally connected to said upper axle assembly and said at least one pivotable, extendable leg distal end is pivotally connected to said lower axle assembly which is connected to platform, and said at least one handle is attached to said at least one pivotable, extendable leg.

2. The floating craft stabilization platform of claim 1 wherein said upper axle tube has a first portion of a lock mechanism and said upper axle has at least one receiving slot matingly conformed to receive said first portion of said lock mechanism, to lock said platform in a retracted position, and wherein said platform is perforated.

3. The floating craft stabilization platform of claim 2 wherein the number of said front mounting bracket assemblies; said adjustable straps; and said pivotable legs are each two.

4. The floating craft stabilization platform of claim 1 wherein said front mounting bracket assembly further comprises:

an upper U shaped piece of channel having a first linear axis and a strap connector extending therefrom;

a lower U shaped piece of channel having a second linear axis; and at least two first U-bolt and nut arrangements;

wherein said lower U shaped piece of channel is affixed to the bottom of said upper channel such that said first linear axis and said second linear axis are parallel, and said first U-bolt and nut arrangements are threadingly engaged about a set of first orifices in said upper channel so as to form two enclosed rings that clamp said front mounting bracket assembly to said frame of the floating craft.

5. The floating craft stabilization platform of claim 4 wherein said adjustable strap is a flexible fabric strap having an adjusting buckle thereon for shortening said strap.

6. The floating craft stabilization platform of claim 5 wherein said pivotable leg comprises:

an inner leg member;

an outer leg member;

a leg mounting bracket;

a top guide; and a locking pin wherein said inner leg member slidingly resides within said outer leg member so as to enable a telescopic adjustment of said leg wherein a set of matchingly dimensioned locking pin orifices are formed through both said outer leg member and said inner leg member so as to accommodate said locking pin to affix the length of said leg; and wherein said top guide is affixed to said outer leg member and dimensionally sized to accommodate sliding movement of said handle therewithin; and wherein said leg mounting bracket is pivotally affixed to said inner leg member by said lower axle.

7. A floating craft stabilization platform for attaching to a frame of a floating craft comprising;

a pivotable platform;

an upper axle assembly made of an upper axle rotationally housed within an upper axle tube;

a lower axle assembly made of a lower axle rotationally housed within a lower axle tube;

at least one adjustable strap;

at least one pivotable, extendable leg having a distal and proximate end; and wherein said upper axle assembly is mechanically affixed to said frame of a floating craft, and said at least one adjustable strap is adjustably connected between said frame of said floating craft and said platform, and said at least one pivotable, extendable leg proximate end is pivotally connected to said upper axle assembly and said at least one pivotable, extendable leg distal end is pivotally connected to said lower axle assembly; and wherein said lower axle assembly is connected to said platform.

8. The floating craft stabilization platform of claim 7 wherein said upper axle tube has a pivotable lock mechanism affixed to an outer surface thereof that is passable through an orifice formed through said axle tube and into at least one slot formed into said axle so as to lock said platform in a retracted position.

9. The floating craft stabilization platform of claim 7 wherein the number of said adjustable straps; and said pivotable legs are each two.

10. The floating craft stabilization platform of claim 9 wherein said adjustable strap is a flexible fabric strap having an adjusting buckle thereon for shortening said strap.

11. The floating craft stabilization platform of claim 10 wherein said pivotable leg comprises:

an inner leg member;

an outer leg member;

a leg mounting bracket;

a top guide; and a locking pin wherein said inner leg member slidingly resides within said outer leg member so as to enable a telescopic adjustment of said leg wherein a set of matchingly dimensioned locking pin orifices are formed through both said outer leg member and said inner leg member so as to accommodate said locking pin to affix the length of said leg; and wherein said top guide is affixed to said outer leg member and dimensionally sized to accommodate sliding movement of said handle therewithin; and wherein said leg mounting bracket is pivotally affixed to said lower axle which passes through said inner leg member and said leg mounting bracket is affixed to said platform.

12. The floating craft stabilization platform of claim 7 wherein said platform is perforated.

* * * * *